US005659991A

United States Patent [19]

Kennedy

[11] Patent Number: 5,659,991

[45] Date of Patent: Aug. 26, 1997

[54] PICTURE FRAME

[76] Inventor: Darrell L. Kennedy, 2087 South St., Elgin, Ill. 60123

[21] Appl. No.: 547,433

[22] Filed: Oct. 24, 1995

[51] Int. Cl.[6] ..... A47G 1/06

[52] U.S. Cl. ..... 40/729; 40/732; 40/777; 40/796

[58] Field of Search ..... 40/729, 732, 748, 40/757, 777, 790, 796, 152.1

[56] References Cited

U.S. PATENT DOCUMENTS

| | | | |
|---|---|---|---|
| 70,116 | 10/1867 | Poinier | 40/732 |
| 1,041,776 | 10/1912 | Gibson | 40/796 X |
| 1,692,999 | 11/1928 | Siegel | 40/732 |
| 2,735,205 | 2/1956 | Knox | 40/732 |
| 3,665,629 | 5/1972 | Shore | 40/790 |
| 3,745,680 | 7/1973 | Faust | 40/732 |
| 5,230,172 | 7/1993 | Hsu | 40/757 X |
| 5,253,440 | 10/1993 | Chang | 40/748 |
| 5,438,777 | 8/1995 | Howell | 40/790 |
| 5,524,370 | 6/1996 | Roy | 40/748 |

FOREIGN PATENT DOCUMENTS

| | | | |
|---|---|---|---|
| 957497 | 11/1974 | Canada | 40/152.1 |
| 702669 | 4/1931 | France | 40/152.1 |
| 22602 | 9/1912 | Sweden | 40/152.1 |

*Primary Examiner*—Kenneth J. Dorner
*Assistant Examiner*—Andrea Chop
*Attorney, Agent, or Firm*—Chase & Yakimo

[57] ABSTRACT

A picture frame assembly comprises a first background panel for affixation to a wall surface, the panel having at least one aperture for releasable insertion of a picture frame therein. Tabs on the rear of the frame releasably secure the frame to slots in the panel for display of the frame in a wall hanging mode. Molding about the frame overlies the defining edge of the panel aperture. Removal of the tabs from the panel slots allows the frame to be disengaged from the panel. A leg on the rear surface of the removed frame supports the removed frame on a horizontal surface. The assembly thus presents structure allowing for picture display in wall mounted or stand alone modes.

9 Claims, 11 Drawing Sheets

PICTURE FRAME

BACKGROUND OF THE INVENTION

This invention relates to a picture frame and, more particularly, to a picture frame assembly which allows for releasable picture frames to be presented at either wall hanging or stand alone positions.

The use of picture frames to display photos, prints, paintings, etc. is known. Frames have also been devised to display the contents in either a wall mounted or stand alone positions. However, such frames have not been designed to be effectively interchanged between either wall mounted or stand alone display modes. Accordingly, it is desirable to have a picture frame which presents an aesthetically pleasing wall mounted display as well as a stand alone play such as on a tabletop, desk or the like. Moreover, it is desirable to be able to interchange the picture frames between such modes without the need to mar and/or blemish, the wall hanging surface.

In response thereto I have invented a novel picture frame assembly which presents a decorative background panel for initial affixation to a vertical surface such as a room wall or the like. This wall panel presents one or more apertures designed to releasably receive a picture frame therein. The picture frame includes tabs releasably engageable with panel slots to maintain the frame in a wall mounted position. The frame includes a swing-away leg which enables it to be supported on a horizontal surface. Each picture frame is removable from the panel while the panel remains affixed to the wall. Such structure allows for insertion of another picture frame within the exposed panel aperture without the need to affix the picture frame directly to the wall.

Accordingly, it is a general object of this invention to provide a novel picture frame assembly which allows for display of one or more pictures in either wall or stand alone displays.

Another object of this invention is to provide an assembly, as aforesaid, having a background panel for wall affixation, the panel displaying at least one frame aperture for positioning a releasable picture frame therein.

Still another object of this invention is to provide an assembly, as aforesaid, the frame having structure for releasable engagement with the background panel.

Another object of this invention is to provide an assembly, as aforesaid, having fastener means on the panel engageable with complementary fastener means on the picture frame for releasably securing the picture frames to the background panel.

A more particular object of this invention is to provide an assembly, as aforesaid, the panel, apertures and picture frame adaptable to various configurations.

Another particular object of this invention is to provide an assembly, as aforesaid, the configuration of the engaged picture frame covering the outline of the panel aperture.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
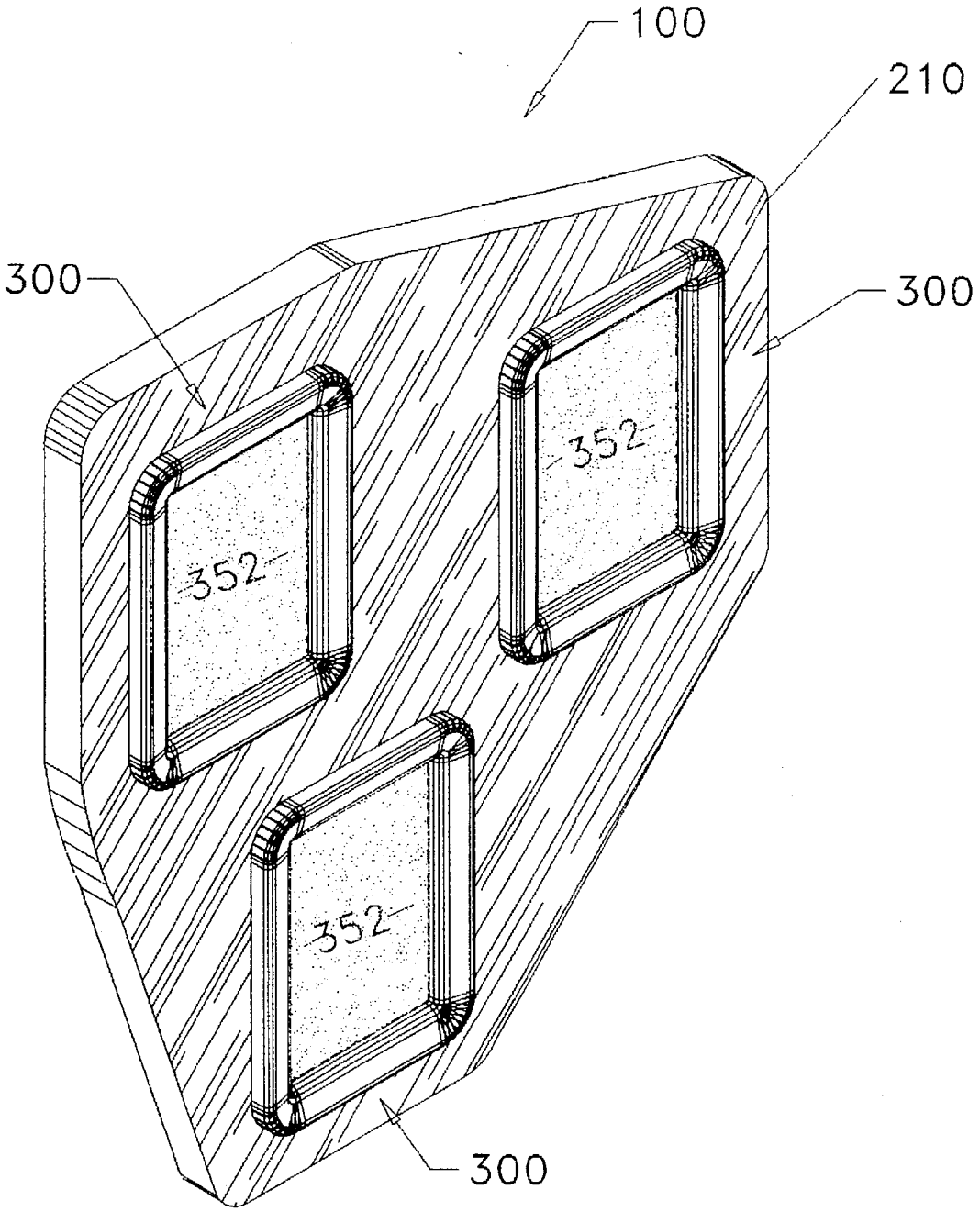
FIG. 1 is a perspective view of a multiple display picture frame assembly.
Figure 2:
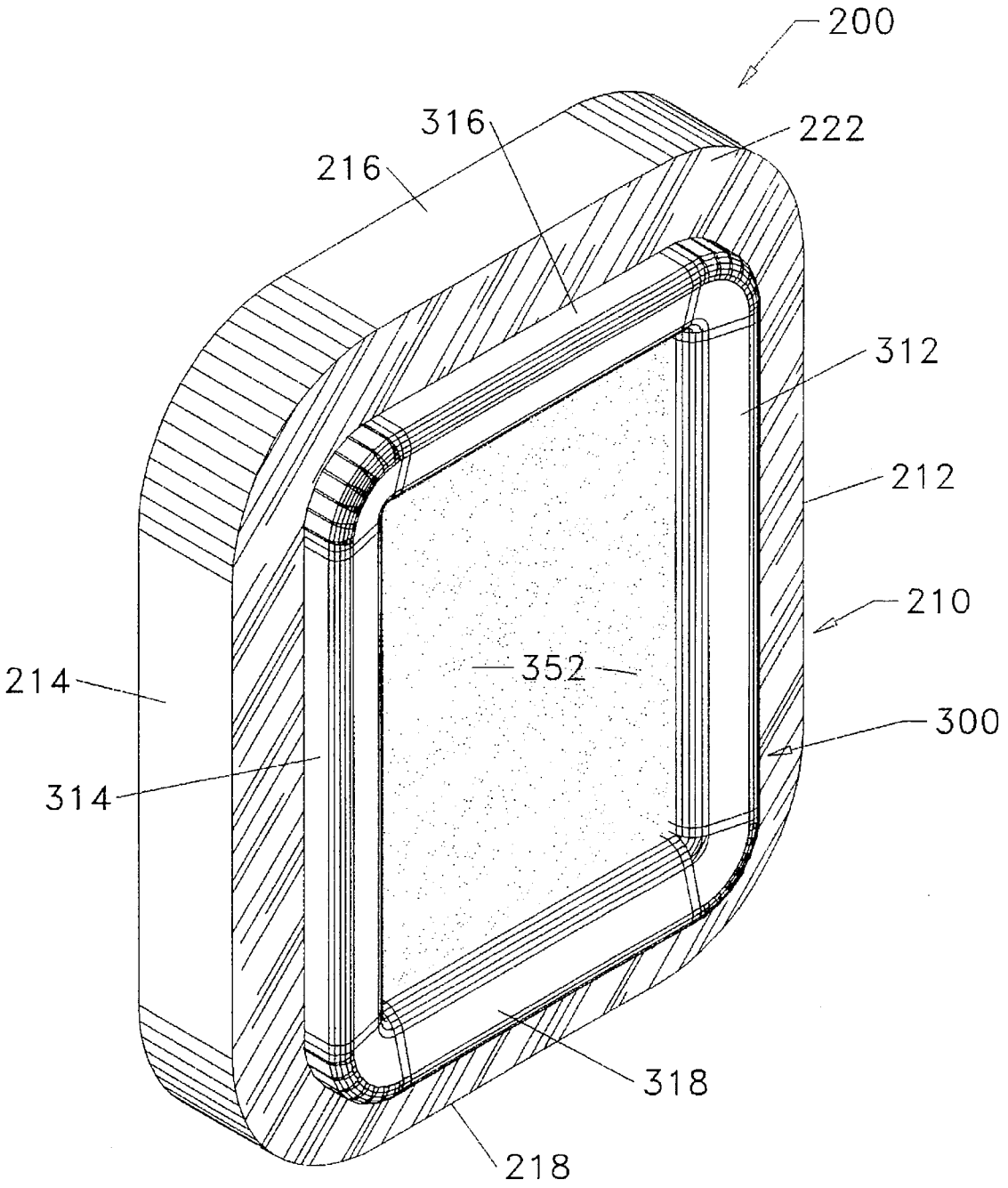
FIG. 2 is a perspective view of a single display picture frame assembly.
Figure 3:
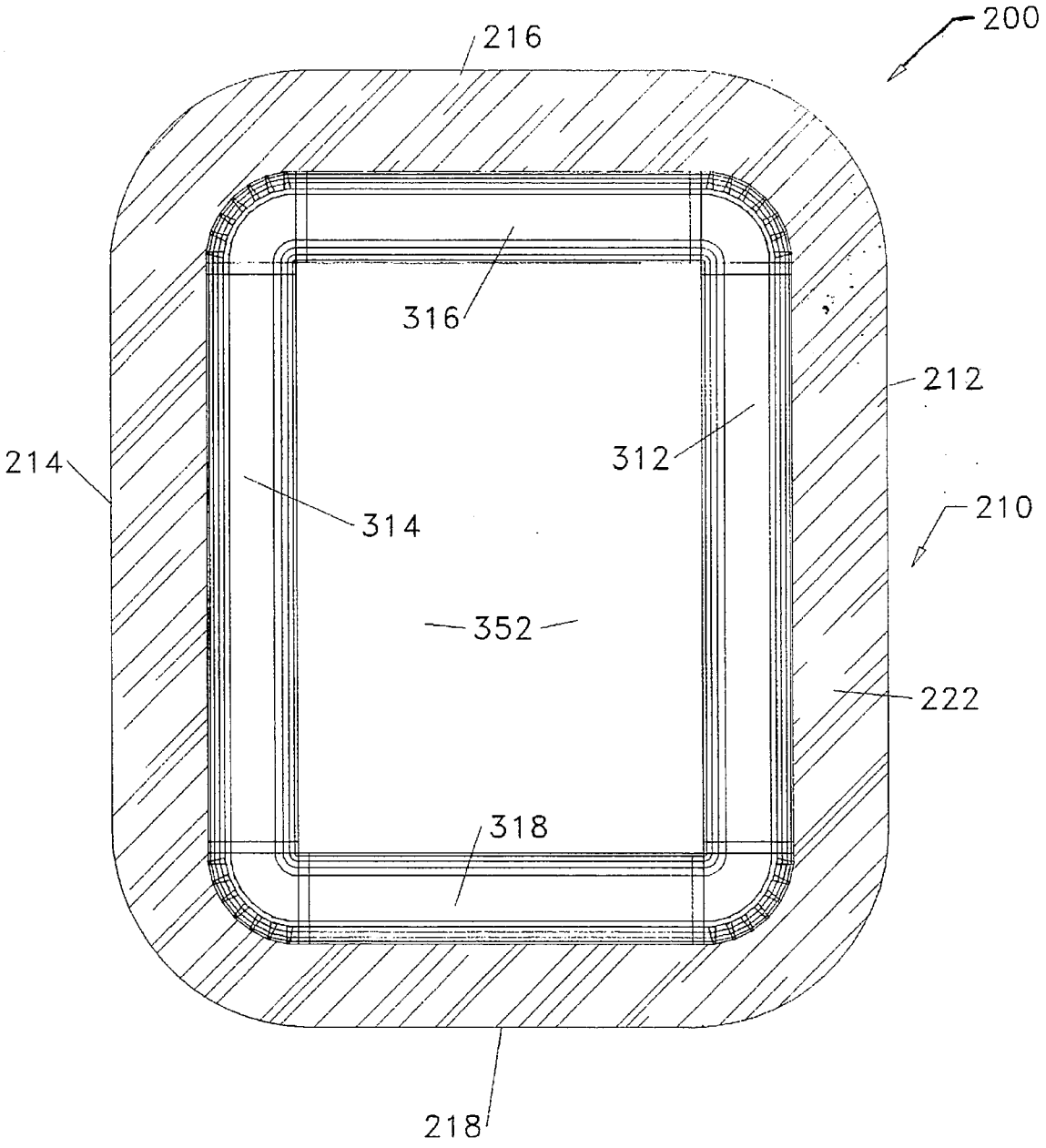
FIG. 3 is a front view of the picture frame assembly of FIG. 2.
Figure 4:
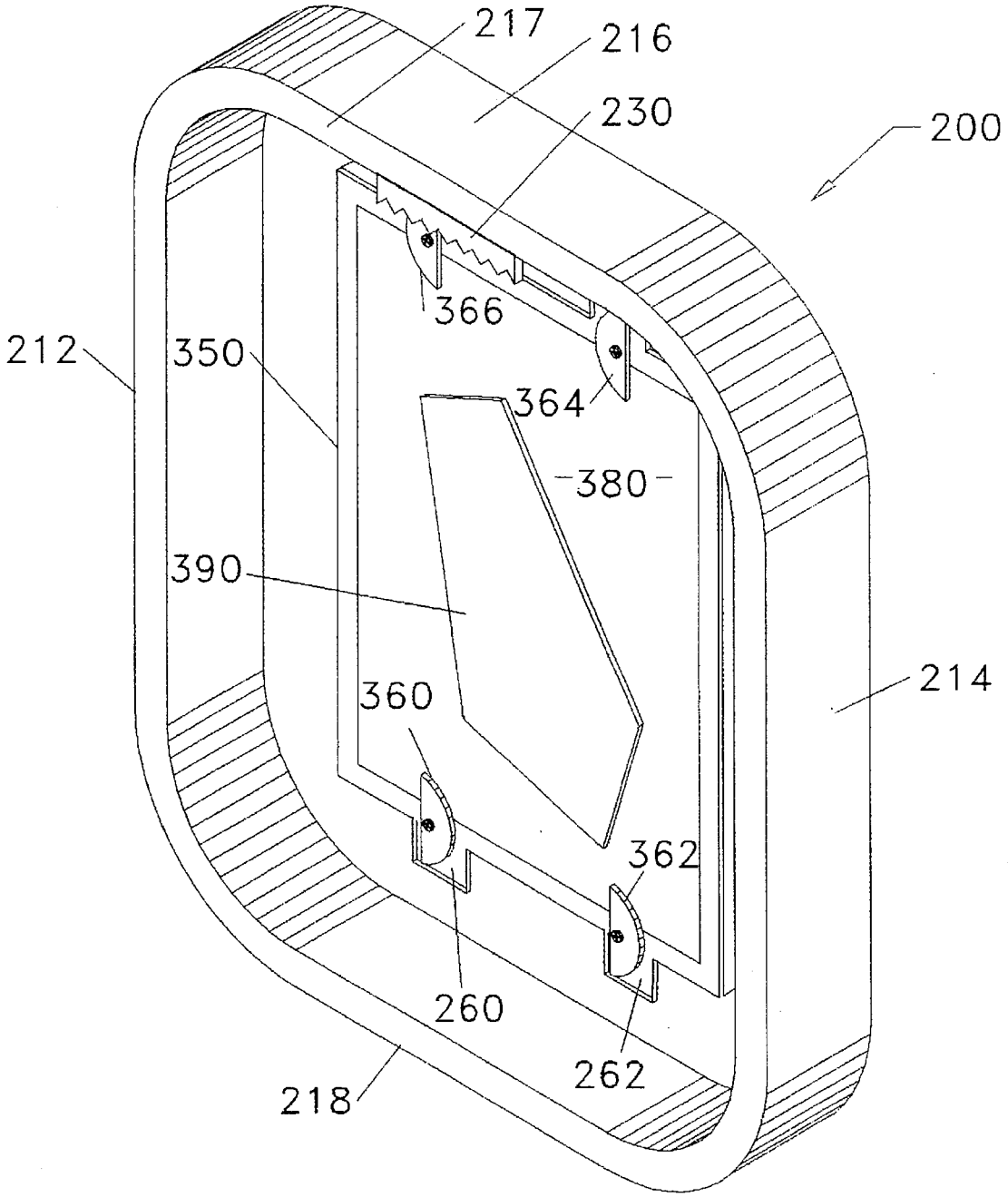
FIG. 4 is a rear perspective view of the picture frame component of the FIG. 2 assembly.
Figure 5:
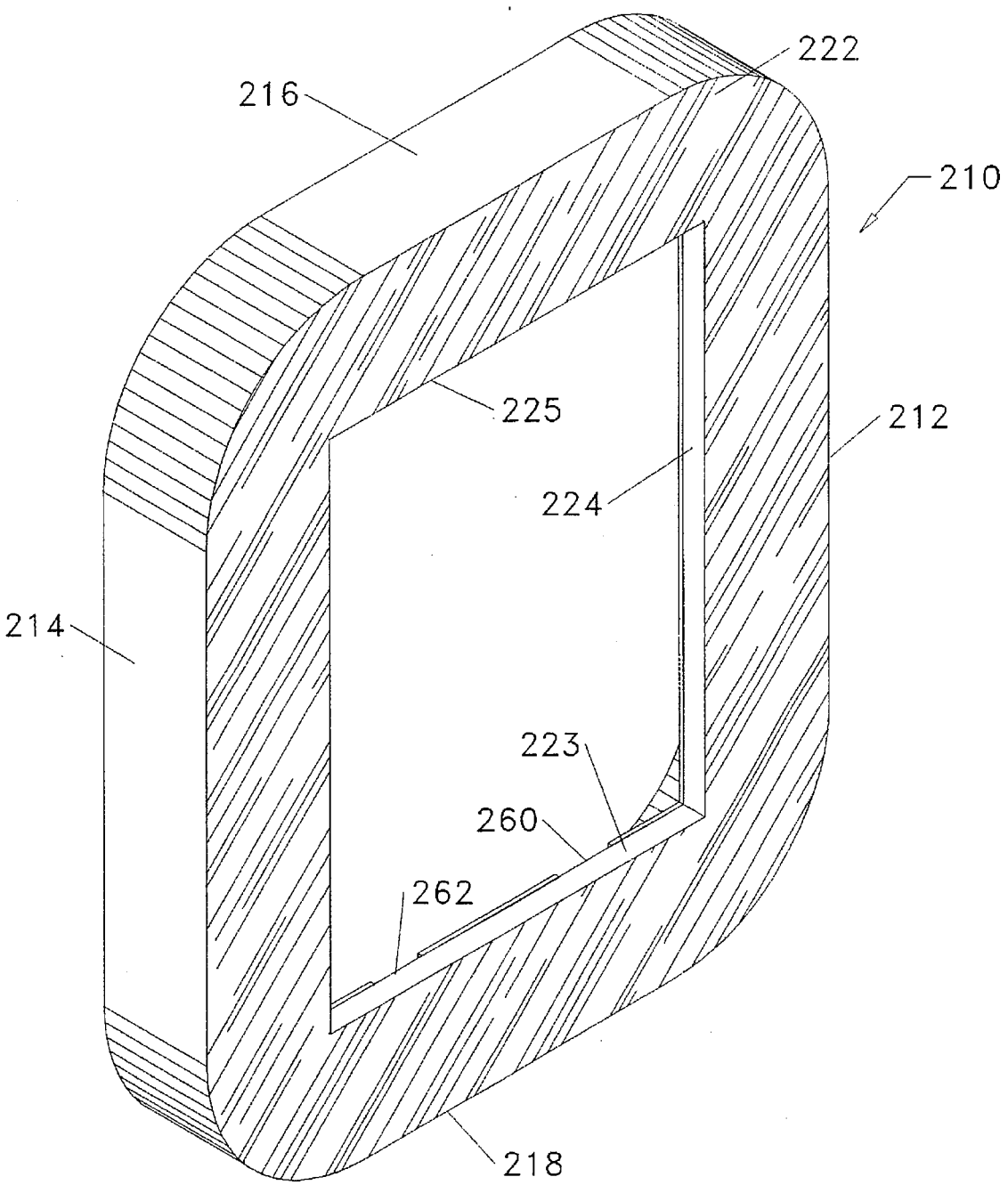
FIG. 5 is a front perspective view of the panel component of the FIG. 2 assembly with the picture frame removed.
Figure 6:
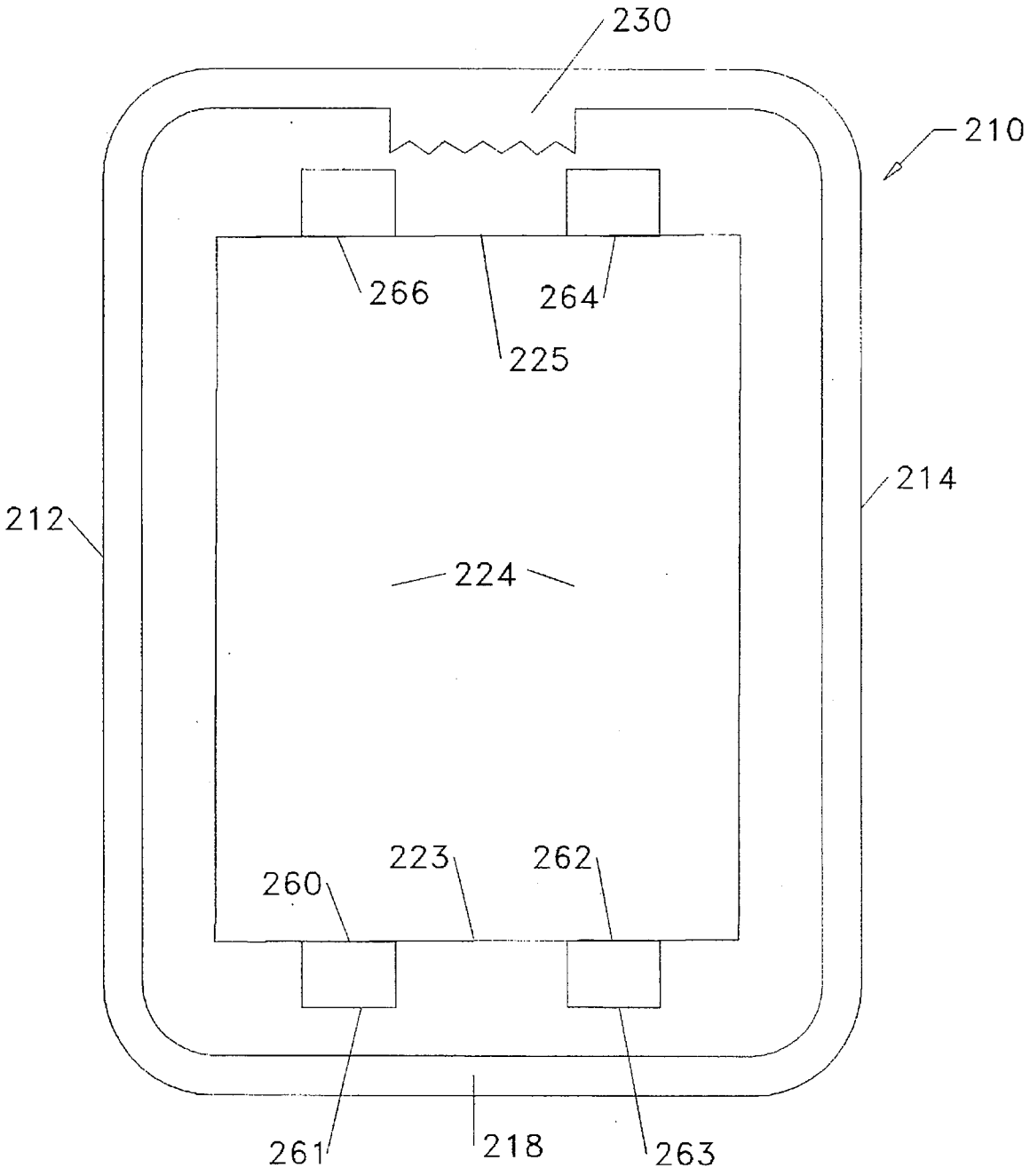
FIG. 6 is a rear view of the panel component of FIG. 5.
Figure 7:
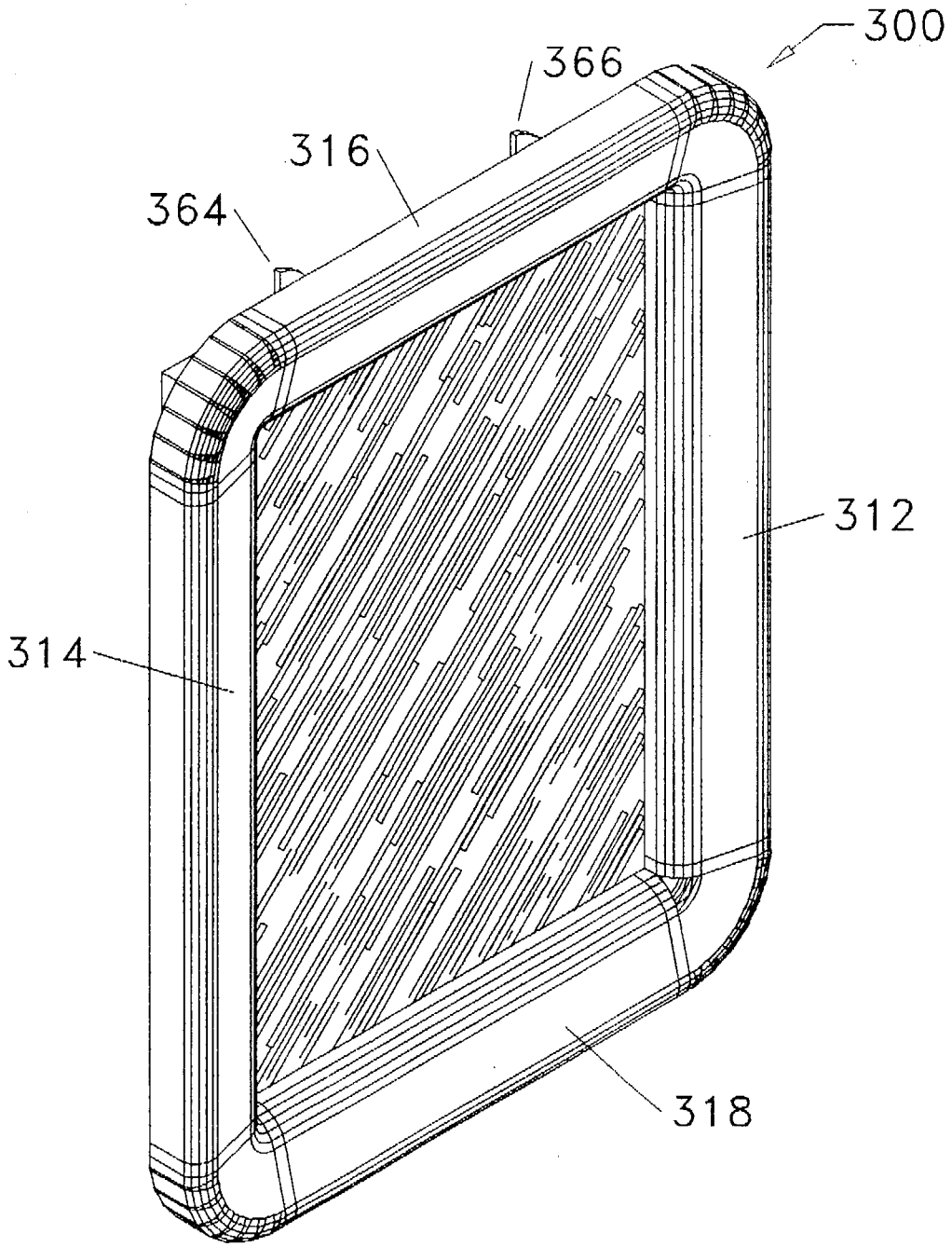
FIG. 7 is a front perspective view of the picture frame component as removed from the FIG. 2 assembly.
Figure 8:
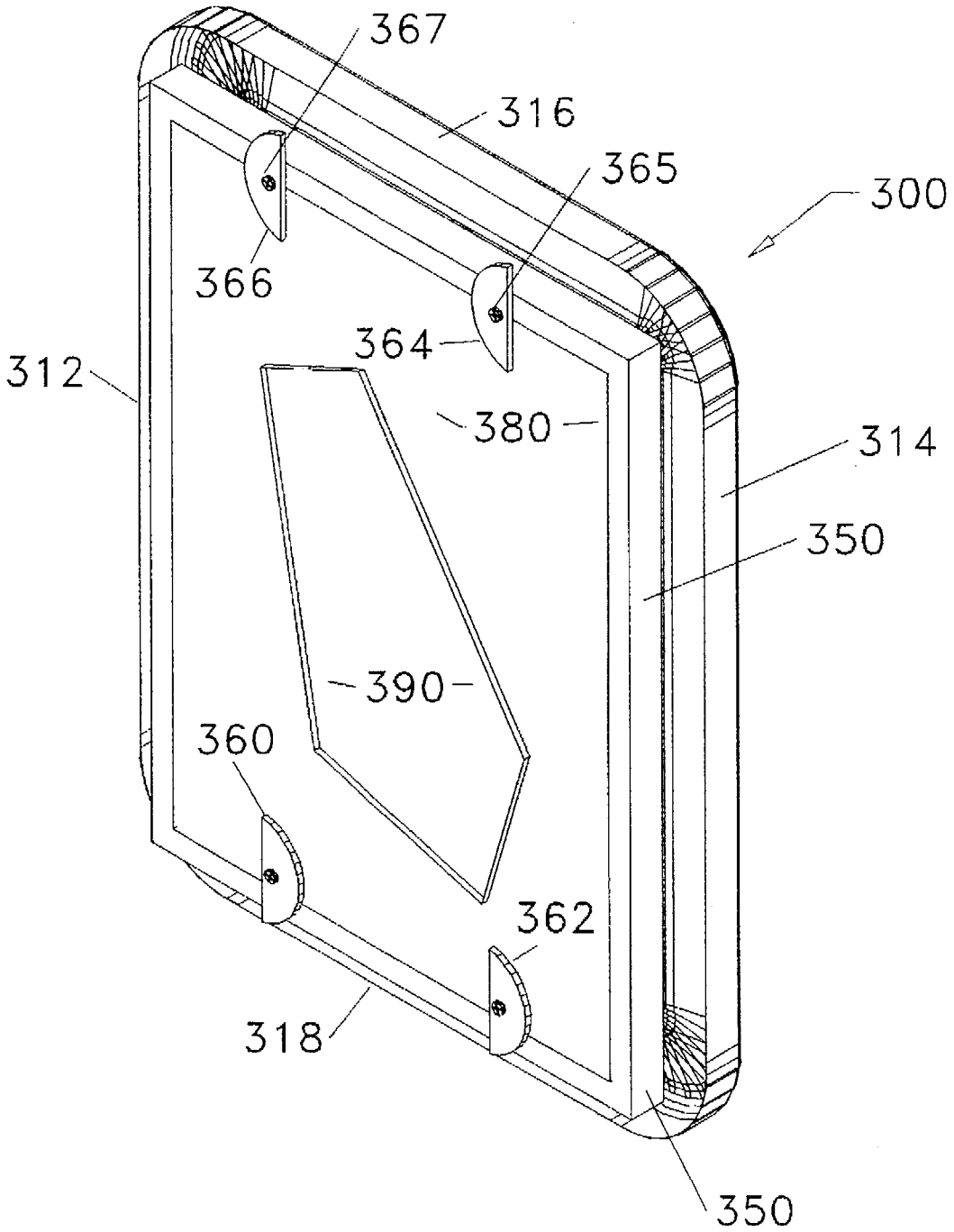
FIG. 8 is a rear view of the picture frame of FIG. 7.

Turning more particularly to the drawings, FIGS. 1 and 2 illustrate first 100 and second 200 embodiments of my invention in multiple and single picture display modes. For purposes of illustration and not limitation, the single display embodiment 200 will be herein set forth, it being understood that the disclosed concepts are available for use in the FIG. 1 multiple display embodiment 100.

As such the single display picture frame 200 generally comprises a wall panel 210 presenting a generally rectangular configuration, it being understood that the panel 210 configuration can assume various forms. Panel 210 presents a pair of side walls 212, 214 and top 216 and bottom 218 walls. The panel 210 further presents a front wall 222 with aperture 224 therein.

On the interior edge 217 of top wall 216 is a conventional hanger 230 for panel suspension from a nail or the like embedded in the wall surface. Also found on the interior surface of the front wall 222 at the lower 223 and upper 225 edges of aperture 224 are a plurality of recessed rectangular slots 260, 262, 264, 266 for a purpose to be subsequently described.

The front of the picture frame assembly 300 presents a molding having a configuration greater than the aperture 224 configuration. The picture frame molding presents a pair of side walls 312, 314 and top 316 and bottom 318 walls. This molding configuration surrounds a compartment 350 having a front glass surface 352, the compartment configuration designed to slide through panel aperture 224 such that the moldings will overly the edges of the panel aperture 224.

Figure 10A:
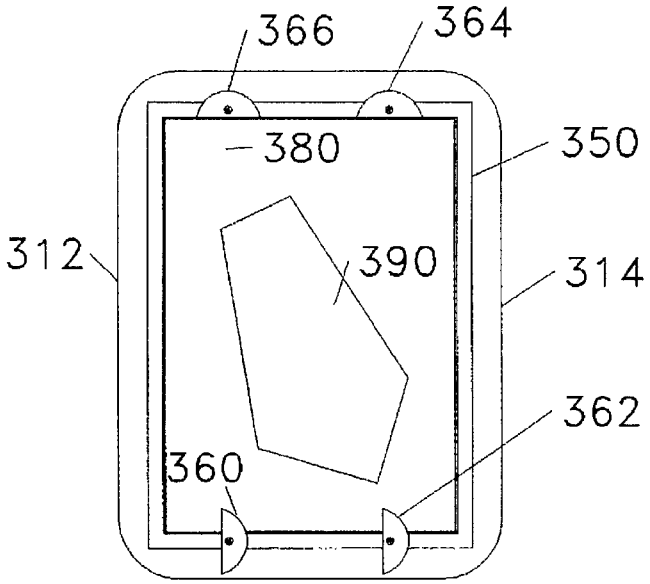
FIGS. 10*a*, 10*b*, 10*c* are rear views of the picture frame component showing the different positions of the picture frame tabs on the rear thereof.
Figure 11:
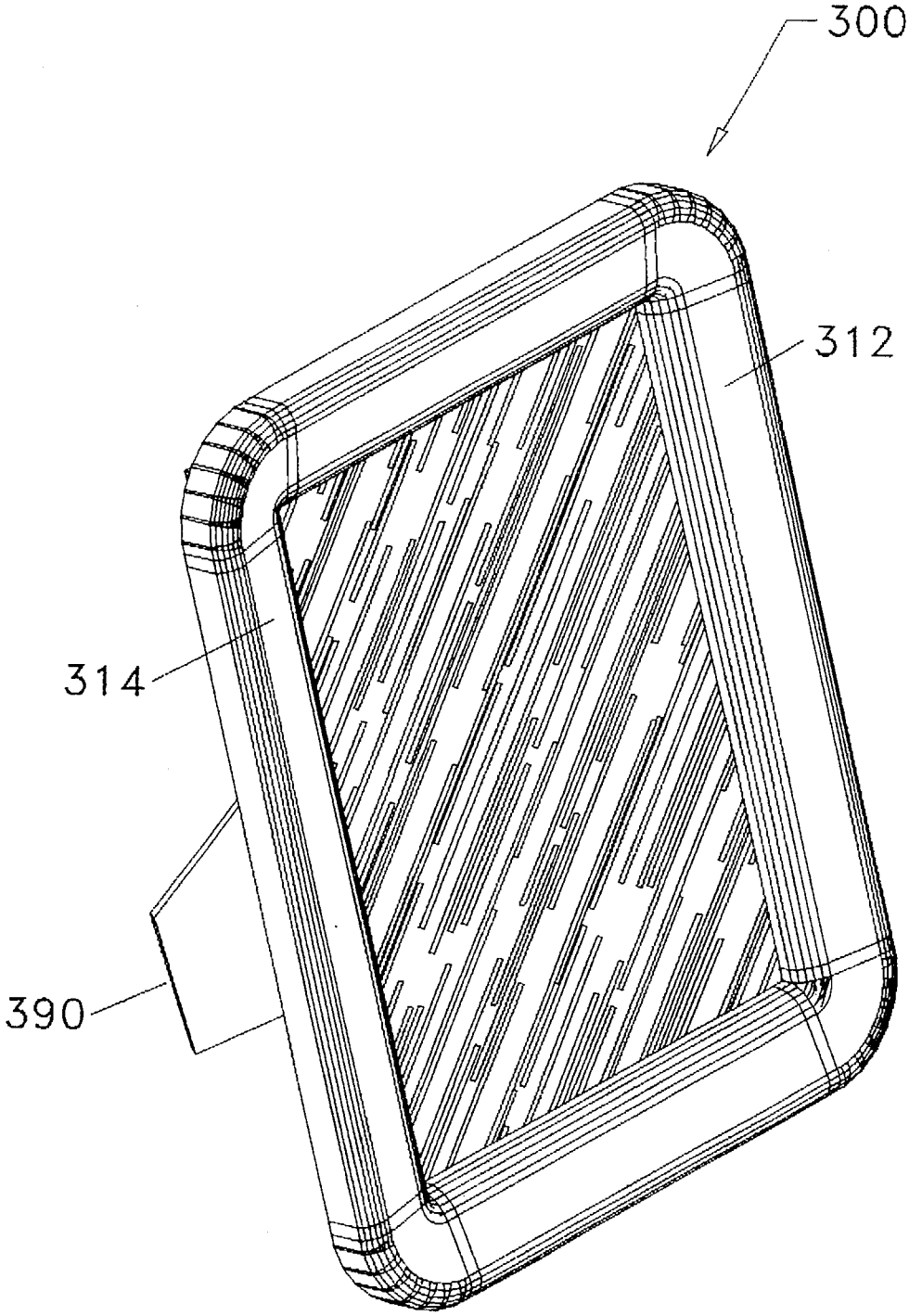
FIG. 11 is perspective view of the picture frame in a stand alone display.

Affixed to the rear of the compartment 350 are a plurality of semi-circular tabs or flanges 360, 362, 364, 366 with tabs/flanges 364, 366 being rotatable around screws 365, 367. Rotation of flanges 364, 366 to a position as shown in FIG. 10*a* allows for removal of back plate 380 which forms the back wall of compartment 350. Upon removal of the back plate 380 a picture may be inserted within the compartment 350 for display through the front glass 352 of the frame 300. Further pivotally affixed to the back plate 380 at a top end is a leg 390 swingable between a position adjacent the back plate 380 and a position displaced therefrom as best shown in FIG. 11.

Figure 10B:
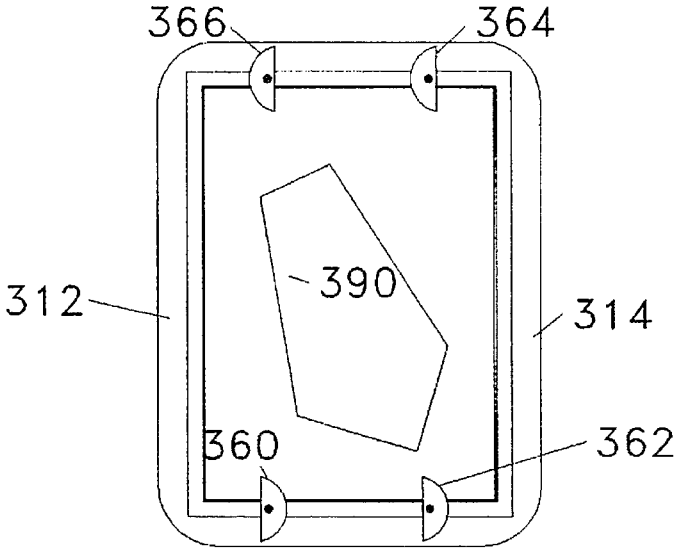

In use, the frame compartment 350 of the frame proper 300 is insertable through panel aperture 224 with the upper flanges 364, 366 being rotated to a FIG. 10*b* position such that the straight edge of the flanges is in a vertical position. At this position the flanges 364, 366 can initially slide into the slots 264, 266. The remainder of the frame is then urged through aperture 224. The lengths of the slots 264, 266 allow the upper flanges 364, 366 to upwardly slide in slots 264, 266 so that lower flanges 360, 362 may pass over the aperture's 224 lower edge 223 and into the lower slots 260, 262. The length of upper slots 264, 266 may be greater than the length of the lower slots 260, 262. This relationship allows the tabs 360, 362 of frame 300 to slide downwardly until these flanges 360, 362 engage the bottom wall of the slots 260, 262, the tabs 364, 366 remaining in upper slots 264, 266. Accordingly, the engagement of the tabs/flanges within their respective slots secure the picture frame 300 to the panel 210 in a wall display position, the molding 312, 314, 316, 318 overlying the defining edge of the panel aperture 224.

Figure 9A:
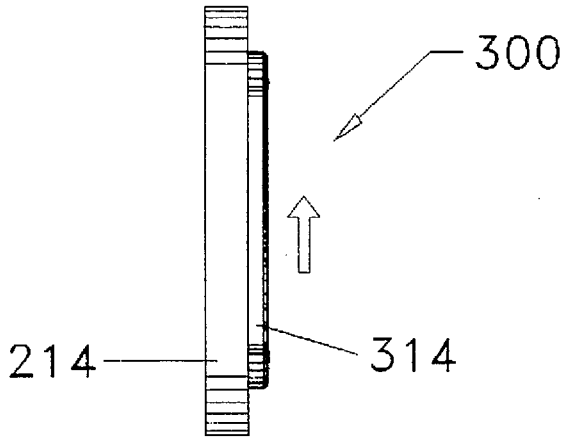
FIGS. 9*a*, 9*b*, 9*c* are side views of the picture frame assembly, on a reduced scale, showing the removal of the picture frame from the background panel.
Figure 9B:
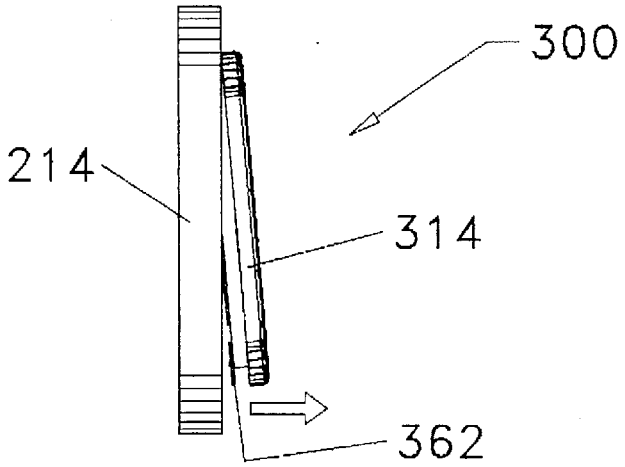
Figure 9C:
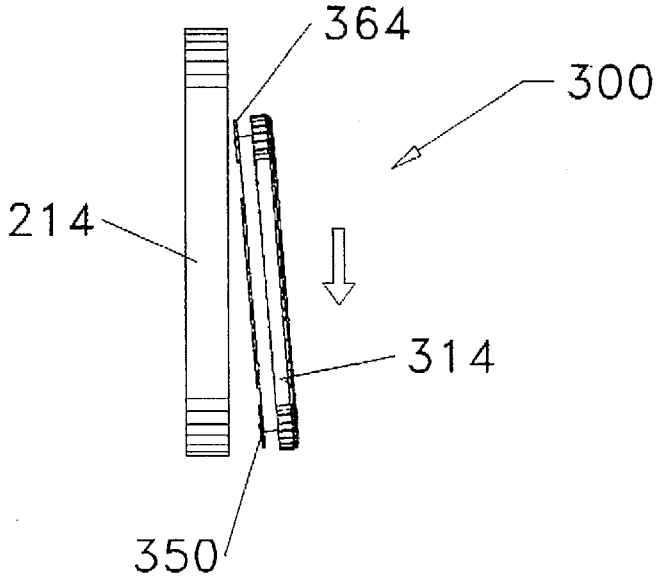
Figure 10C:
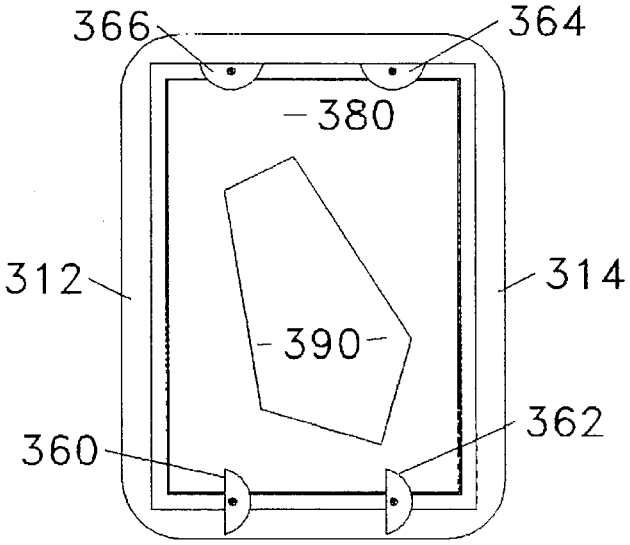

For a tabletop display of frame 300, the frame is removed from the panel 200 by upwardly sliding the flanges 364, 366 to the upper extent of the slots 264, 266 (FIG. 9*a*) and then urging the bottom portion of the frame compartment 350 and tabs 360, 362 over the lower edge 223 of the panel aperture 224 (FIG. 9*b*). Once the bottom edge of frame 300 is beyond aperture 224 (FIG. 9*b*), the upper flanges 364, 366 are able to slide downwardly from the slots 264, 266 (FIG. 9*c*). Once tabs 364, 366 are free from slots 264, 266, the entire frame 300 is removable from the panel 200 aperture 224 (FIG. 9*c*). At this position flanges 364, 366 may be rotatable about screws 365, 367 so that the upper flanges 364, 366 are horizontal and hidden by the compartment 350 when frame 300 is viewed from the front thereof (FIG. 10*c*). The leg 390 on the back plate 380 is then displaced from the back plate 380 surface enabling the frame 300 to be displayed in a stand alone position (FIG. 11). As such, another frame 300 may engage the aperture 224 of panel 200, as above described, so as to replace the frame 300 now presenting a stand alone display.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A picture frame assembly comprising:

a panel having front and rear surfaces for attachment to a vertical surface;

an aperture in said panel presenting an edge defining a configuration of said aperture;

a picture frame having a configuration adapted to fit within said panel aperture;

at least one upper slot on said rear surface of said panel adjacent said aperture edge at an upper extent of said aperture configuration;

at least one lower slot on said rear surface of said panel adjacent said aperture edge at a lower extent of said aperture configuration, said upper slot having a length longer than a length of said lower slot;

at least one first tab on said picture frame at an upper extent thereof for an initial positioning within a corresponding said at least one upper slot;

at least one second tab on said picture frame at a lower extent thereof for a subsequent positioning within a corresponding said at least one lower slot, said longer length of said at least one upper slot relative to said lower slot allowing for an initial mating of said corresponding first tab in said at least one upper slot prior to said mating of said corresponding second tab in said lower slot, whereby said umber and lower slot lengths allow for insertion of said picture frame with said tabs through said front surface of said panel for positioning within said panel aperture.

2. The assembly as claimed in claim 1 wherein said at least one first tab is rotatable between a first position extending beyond an edge of said frame for engaging said corresponding upper slot and a second position behind said frame upon a disengagement of said frame from said panel.

3. The assembly as claimed in claim 2 wherein said at least one first tab is rotatable between said first position relative to said frame for engaging said corresponding upper slot and a third position for allowing removal of a back wall of said picture frame, said back wall removal allowing for insertion of a picture within said frame.

4. The assembly as claimed in claim 1 further comprising:

molding about said picture frame, said molding overlying said edge defining said aperture configuration upon said positioning of said picture frame in said aperture.

5. A picture frame assembly comprising:

a panel having a configuration presenting front and rear surfaces, said configuration adapted for attachment to a vertical surface;

an aperture in said panel presenting an edge defining a configuration of said aperture;

a picture frame presenting a compartment for displaying a picture, said compartment having a configuration adapted to fit within said panel aperture;

at least one upper slot on said rear surface of said panel adjacent said aperture edge at an upper extent of said aperture configuration;

at least one lower slot on said rear surface of said panel adjacent said aperture edge at a lower extent of said aperture edge, said at least one lower slot being shorter in length than said upper slot;

a first tab on said picture frame at an upper extent of said frame for insertion within a corresponding said at least one upper slot;

a second tab on said picture frame at a lower extent of said frame for insertion within a corresponding said at least one lower slot, said upper and lower slot lengths enabling a sequential insertion of said first tab in said corresponding at least one upper slot before insertion of said second tab in said corresponding at least one lower slot upon insertion of said picture frame compartment through said front surface of said panel and into said aperture, said tabs in said slots engaging said picture frame to said panel and said compartment within said panel aperture for display of a picture therein;

means on a rear surface of said picture frame for supporting said frame on an underlying surface upon a disengagement of said tabs from said slots to disengage said picture frame from said panel.

6. The assembly as claimed in claim 5 wherein said first tab is rotatable between a first position extending beyond said frame for engaging said corresponding upper slot and a second position behind said frame upon said frame disengagement from said panel.

7. The assembly as claimed in claim 6 wherein said first tab is rotatable between said first position relative to said frame for engaging said corresponding upper slot and a third position for allowing removal of a back wall of said picture frame, said back wall removal allowing for insertion of a picture within said frame.

8. The assembly as claimed in claim 5 wherein said support means comprises a leg adjacent a back surface of said frame, said leg engaging the underlying surface upon said disengagement of said picture frame from said panel aperture.

9. The assembly as claimed in claim 5 further comprising:

molding about said picture frame, said molding overlying said edge defining said aperture configuration upon said engagement of said frame in said aperture.

* * * * *

UNITED STATES PATENT AND TRADEMARK OFFICE

CERTIFICATE OF CORRECTION

PATENT NO. : 5,659,991
DATED : August 26, 1997
INVENTOR(S) : DARRELL L. KENNEDY

It is certified that error appears in the above-identified patent and that said Letters Patent is hereby corrected as shown below:

Column 4, line 5, delete "umber" and substitute --upper--.

Column 4, line 13, delete "a".

Column 4, line 56, delete "a".

Signed and Sealed this

Twenty-fifth Day of November, 1997

*Attest:*

*Attesting Officer*

Bruce Lehman

BRUCE LEHMAN

*Commissioner of Patents and Trademarks*